US005836057A

United States Patent [19]

Machfud

[11] Patent Number: 5,836,057

[45] Date of Patent: Nov. 17, 1998

[54] ZIPPER FOR PLASTIC BAGS

[76] Inventor: Daniel Machfud, 8, Yoel St., Sharia, Petach Tikva, Israel

[21] Appl. No.: 973,313

[22] PCT Filed: May 31, 1996

[86] PCT No.: PCT/EP96/02357

§ 371 Date: Jan. 30, 1998

§ 102(e) Date: Jan. 30, 1998

[87] PCT Pub. No.: WO96/38064

PCT Pub. Date: Dec. 5, 1996

[30] Foreign Application Priority Data

Jun. 1, 1995 [IL] Israel ..... 113982

[51] Int. Cl.[6] ..... A44B 21/00; B65D 33/00

[52] U.S. Cl. ..... 24/400; 24/587; 383/63

[58] Field of Search ..... 24/400, 587, 415; 383/63, 64, 202

[56] References Cited

U.S. PATENT DOCUMENTS

| | | | |
|---|---|---|---|
| 1,719,856 | 7/1929 | Sipe | 24/400 |
| 2,665,467 | 1/1954 | Bosomworth et al. | 24/400 |
| 2,994,469 | 8/1961 | Troup et al. | 24/400 |
| 5,167,608 | 12/1992 | Steffens, Jr. et al. . | |
| 5,211,482 | 5/1993 | Tilman . | |

FOREIGN PATENT DOCUMENTS

| | | |
|---|---|---|
| 0543011 | 6/1993 | European Pat. Off. . |
| 1036544 | 9/1953 | France . |
| 1137102 | 5/1957 | France . |

*Primary Examiner*—Victor N. Sakran

*Attorney, Agent, or Firm*—Birch, Stewart, Kolasch & Birch, LLP

[57] ABSTRACT

A zip plastic bags comprising at least one strip of a flexible material (2) for packaging which is stuck to the opening region of the bag, two strips of semi-rigid material (1*a*, 1*b*) attached along said flexible strip (2) which have at least one tongue (3) and groove (4) so that the tongue (3) of one semi-rigid strip (1*a*, 1*b*) can be inserted into the groove (4) of the other semi-rigid strip (1*a*, 1*b*), thereby latching the strips(1*a*, 1*b*) one to another, a clasp (5) that grasps these strips (1*a*, 1*b*; 2) in joining of separating manner as it slides along the strips (1*a*, 1*b* 2) and a tab (6) attached to the clasp (5) for sliding the clasp (5) and for tearing open the bag, when opened the first time, with the aid of sharp protrusion or pin (7) positioned on the tip of the tab (6).

6 Claims, 3 Drawing Sheets

ZIPPER FOR PLASTIC BAGS

This application claims the benefit under 35 U.S.C. §371 of prior PCT International Application No. PCT/EP96/02357 which has an International filing date of May 31, 1996 which designated the United States of America, the entire contents of which are hereby incorporated by reference.

FIELD OF THE INVENTION

The present invention relates to a device for opening and sealing bags and, more specifically, to a zip for plastic bags as used for packaging candy and other food products. The zip of the present invention is stuck to a bag and can be used for tearing open the initially closed bag. Thereafter, the zip can be used for a multiple opening and closing of the bag.

BACKGROUND OF THE INVENTION

Many food products and a variety of other products are sold and sealed in plastic bags such as candy bags, bags of snacks, instant soup bags, pasta bags and nut bags. This applies also to many powdery substances such as soap powder or construction materials like cement or sand. Furthermore, diapers and toilet paper are often packaged with a plastic bag. However, when the plastic wrappings has been opened or torn, the bag cannot be closed again other than, imperfectly and provisionally, by means of a clip or rubber band.

The present invention provides a solution to this problem in form of special zip (hereinafter called the zipper) that can be attached to the bag and used as a zipper for opening and closing of the bag. Until its first use the bag is completely sealed in the plastic wrapping. After the first opening of the bag, i.e. by tearing the plastic material with the aid of the sharp protrusion on the zipper, the zipper allows a resealing of the bag whereby two plastic strips are latched one to another.

SUMMARY OF THE INVENTION

The present invention relates to a zip for plastic bags comprising a strip of a flexible material which is attached to the opening region of the bag, and

- two strips of a semi-rigid material which are attached along said strip of flexible material and have a tongue and groove so that the tongue of one of the semi-rigid strips can be inserted into the groove of the other semi-rigid strip thereby latching the semi-rigid strips one to another,
- a clasp which grasps these strips in joining or separating manner as it slides along the strips, and
- a tab attached to the clasp which can be used for sliding the clasp while sealing and opening the bag and for separating the semi-rigid strips and, initially, for tearing open the bag with a sharp protrusion and/or pin which is located on the tip of the tab.

DETAILED DESCRIPTION OF THE INVENTION

The present invention relates to a zipper for plastic bags. The zip comprises one or more strips of some flexible material that can be stuck on the opening region of the bag. Along these flexible strips, which are preferably made of a disposable material, are attached two strips of a semi-rigid material such as rubber or silicon. The semi-rigid strips have a groove and a tongue such that the tongue of one of the strips fits into the groove of the other strip, latching the two strips together. The zipper comprises a clasp that can be moved with the aid of a tab attached to it. This clasp grasps together the two semi-rigid strips, joining or separating them, when sliding along the strips. The tab attached to the clasp is used for moving the clasp along the semi-rigid strips while latching or unlatching the tongue and groove. The tap is preferably provided with a pin or a sharp protrusion on the tip of the tab, which serves for tearing open the bag, i.e. for the initially opening the bag.

The term semi-rigid strips pertains to strips of any semi-rigid plastic material, preferably to silicon strips.

The present invention will now be described in detail with reference to accompanying drawings and representative examples, which are intended to delimit the scope of the invention.

DETAILED DESCRIPTION OF THE DRAWINGS

Figure 1:
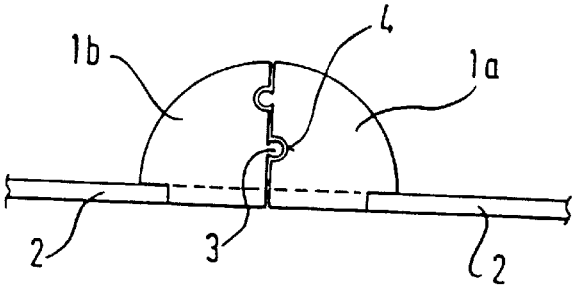
FIG. 1 shows a side view of the two semi-rigid strips attached to the flexible strip.

FIG. 1 is a side view of the two semi-rigid strips 1*a* and 1*b* that are attached to flexible strips 2. The semi-rigid strips are latched on to each other by a tongue 3 that is inserted in the groove of the other strip 4.

Figure 2:
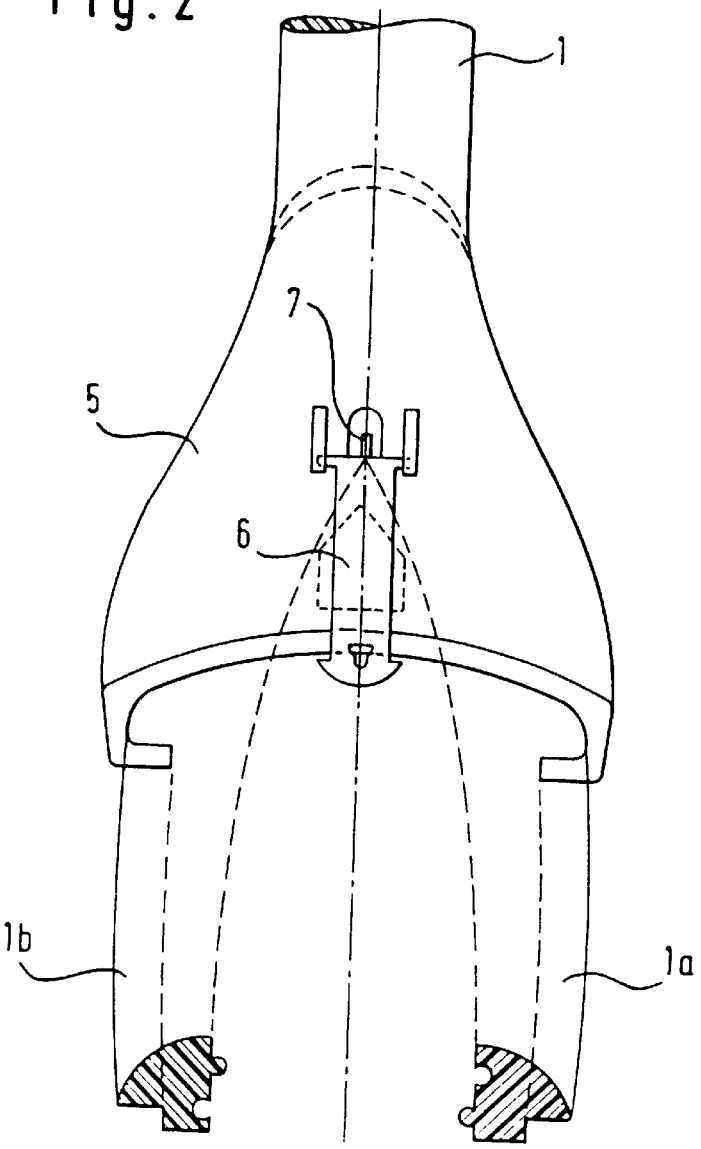
FIG. 2 is an isometric view of the clasp for joining and separating the semi-rigid strips.

FIG. 2 is an isometric view of the clasp 5 gripping the semi-rigid strips 1*a* and 1*b*, and separating them with the aid of a tab 6 positioned in the centre of the clasp, and pressing and latching said strips together with the back side of the clasp so that one strip 1 is created.

Since the semi-rigid strips are attached to a flexible strip stuck to the bag, the bag is open then these strips are open and sealed when they are latched on to each other. On the tip of the tab there is a pin 7 which forms basically a sharp protrusion. When the tab 6 is lifted the pin tears the flexible strip and when sliding the tab 6 along the semi-rigid strips, the bag will be torn and initially opened. The bag can then be sealed by latching the two semi-rigid strips one to another with the clasp. The bag can be opened again by sliding the clasp distally along the strips, like with a zip on clothes.

Figure 3:
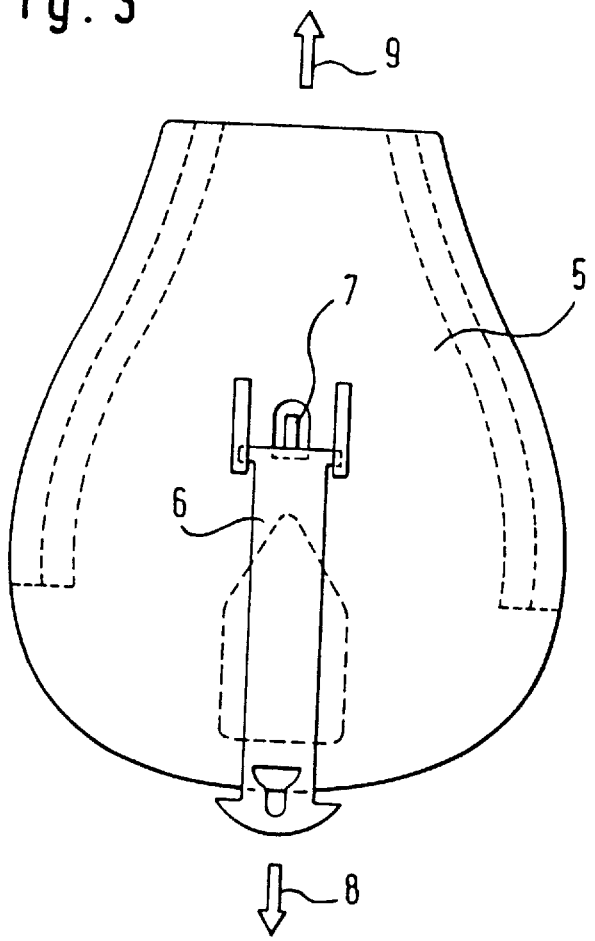
FIG. 3 is a top view of the clasp and the attached tab.

FIG. 3 is a top view of the clasp 5 and the tab 6. A pin positioned on the tip 7 of the tab 6 which can be used for the initial opening tear in the bag.

The clasp moves while grasping the two semi-rigid strips and slides from one end to the other. Referring to FIG. 3, when sliding in direction 8 the clasp latches the two strips on to each other so that they form one unit and that the bag is sealed. When sliding in the other direction 9, the protrusion on the clasp centre opens the latched strip 1 to two parts 1*a* and 1*b*, so that the bag is opened as the said strips are attached to the flexible plastic strip of disposable material.

Figure 4:
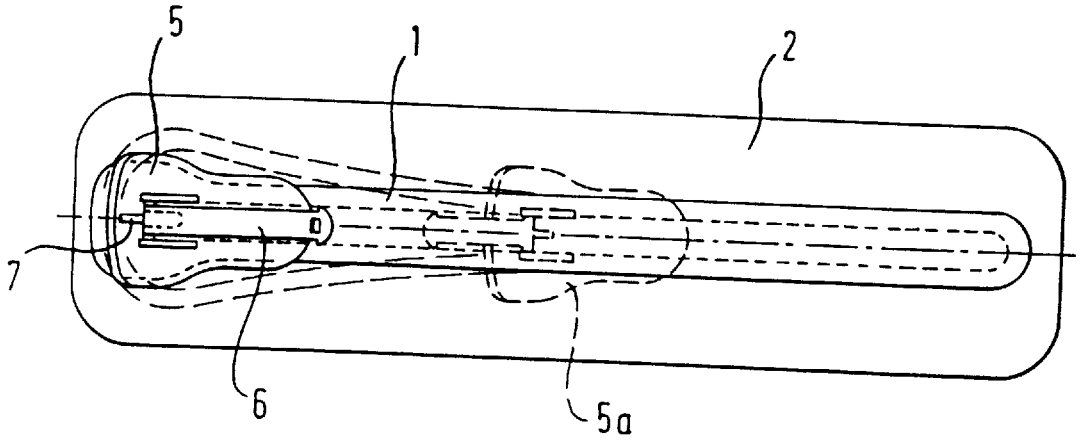
FIG. 4 is a top view of the zipper for opening and closing of plastic bags.

FIG. 4 is a top view of the zipper described in this invention. The flexible strip 2 and all other parts attached to it (semi-rigid strips, clasp etc.) is stuck at the opening region of the bag.

Initially, the clasp 5 is positioned on side of the closed bag and the strips 1*a* and 1*b* are attached to one another. When the clasp 5 is moved towards the centre of the bag 5*a* or to the other side of the bag, the strips will separate and the bag be torn open by a sharp pin 7 that is positioned on the tip of the tab 6. In other words, when the tab is lifted, the pin is thrust downwards into the bag so that bag will be torn when the clasp is moved, so that the never opened bag is torn open for the first time. Further opening of the bag is by moving the clasp.

Moving the clasp back to its original position seals the bag by joining and latching the two strips one to another.

Figure 5:
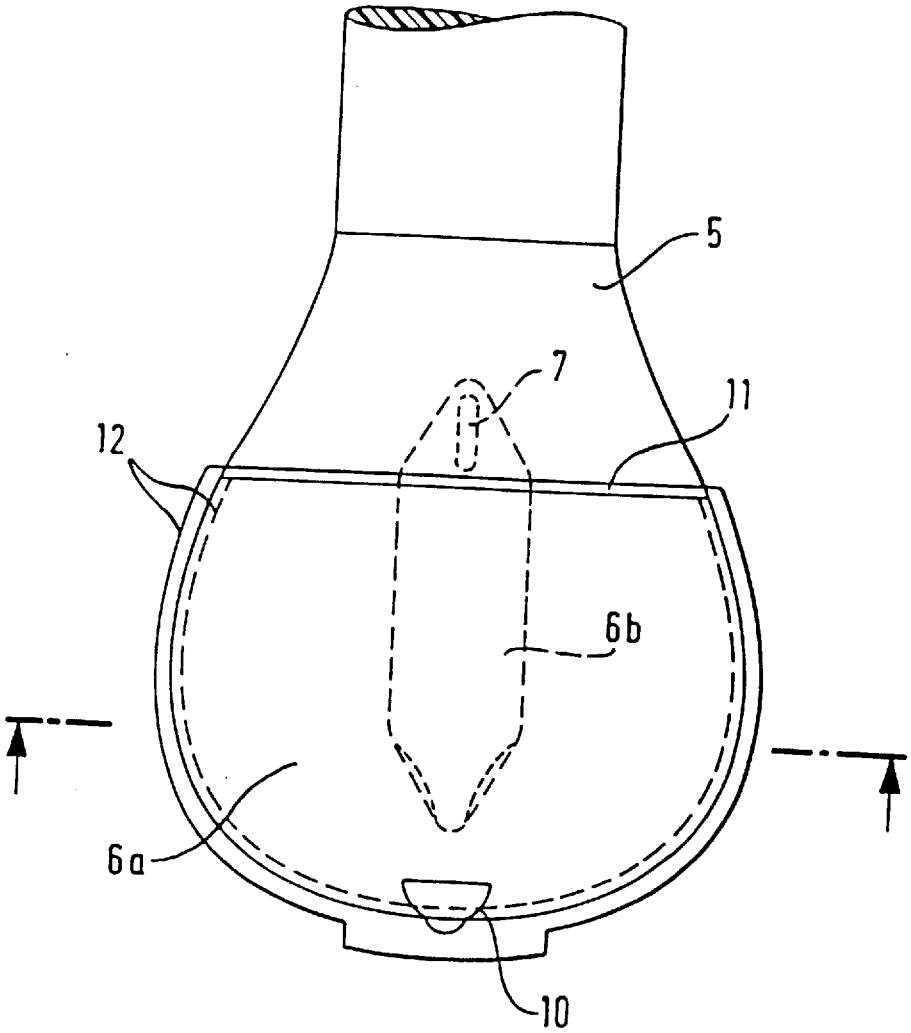
FIG. 5 is a top view of another clasp and tab according to the invention.

FIG. 5 is a top view of another clasp 5 and a tab 6*a*, where the tab is attached to the clasp along the length by a hinge 11 integral with the clasp. The tab is also attached around its outer circumference to the clasp by an interlocking tongue and groove mechanism. On the tab along the axis of the zipper is a pinch-tab 10 for easy initial is grasping and opening of the integrally hinged tab. Also attached to the tab along the axis of the zipper is a tab-guide 6*b* which slides on the tongues and grooves of the zipper when the clasp is pulled. Whereas the function of the clasp is to "pinch" the two sides of the zipper strips together when drawn in closing direction, the tab-guide serves to separate the two sides of the zipper strips when drawn in the opening direction. Attached to the tab-guide along the axis of the zipper is a pin 7 which functions as a sharp protrusion for the initial tearing of the bag along the axis of the zipper 12, i.e. under the portion of the zipper for opening and closing of the bag.

For initial "activation" of the attached zipper-strips, the pinch-tab is therefore pulled to open the hinged tab. This causes the attached pin to pierce the bag. The clasp is then pulled along the length of the zipper so that the sharp pin 7 tears the bag along the length of the zipper and, simultaneously, causes the tab-guide to slide along the length of the zipper. At any point in the initial opening process, or in any of the subsequent opening and closing processes, the hinged tab may be returned to a lock in place position by returning the interlocking tongue and groove (on the circumference of the clasp) to the sealed together position.

There are two pairs of tongues and grooves—one pair along the axis of the zipper and a second pair along the circumference of the clasp. The pair along the axis of the zipper serves for an opening or closing the bag. The pair along the circumference of the clasp serves to lock the zipper at a predetermined open position, in the closed position, or in the initial prior to "activation" position.

Figure 6:
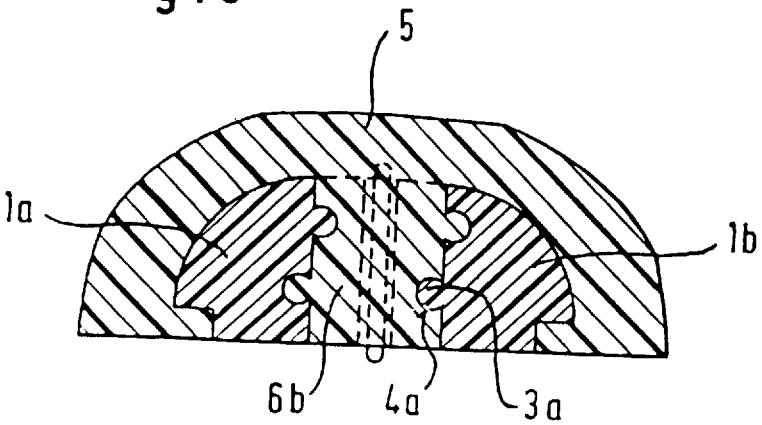
FIG. 6 is a cross-section of the clasp and the tab-guide of FIG. 5 when inserted between the two semi-rigid strips.

FIG. 6 is a cross-section of the clasp 5 and tab-guide 6*b* (from FIG. 5) as inserted between the two semi-rigid strips 1*a* and 1*b*, wherein the tab-guide is shown with lateral tongues and grooves 3*a* and 4*a* which slide along the length of the corresponding tongues and grooves of the semi-rigid strips. Whereas the function of the clasp is to "pinch" the two sides of the zipper semi-rigid strips together when drawn in the closing direction, the tab-guide functions to separate the two sides of the zipper (semi-rigid) strips when drawn in the opening direction.

I claim:

1. A zip for plastic bags comprising for packaging at least one strip of flexible material (2) which is stuck to the opening of the bag to provide a tight seal under the zip, two strips of semi-rigid material (1*a*, 1*b*) which have at least one tongue (3) and groove (4) so that the tongue (3) of one semi-rigid strip (1*a*, 1*b*) can be inserted into the groove (4) of the other semi-rigid strip (1*a*, 1*b*), thereby latching the semi-rigid strips (1*a*, 1*b*) one to another, a clasp (5) that grasps these strips (1*a*, 1*b*) in joining or separating manner as it slides along the strips (1*a*, 1*b*), a tab (6) with a sharp protrusion for opening the bag which is attached to the clasp (5), characterized in that said tab is attached to the clasp along the length by a hinge (11) so that the sharp protrusion (7) on tip of the tab (6) is thrust downwards into the flexible strip (2) or bag when the tab is grasped and lifted and that the bag or flexible strip (2) are torn when the clasp is moved.

2. A zip according to claim 1 wherein the tab (6) has a pinch-tab (10) for easing grasping.

3. A zip according to claim 1 wherein the semi-rigid strips (1*a*, 1*b*) are made of semi-rigid rubber.

4. A zip for plastic bags according to claim 1 wherein the semi-rigid strips (1*a*, 1*b*) are made of silicon.

5. Method of packaging in plastic bags comprising the use of a zip as claimed in any preceding claims 1 to 4.

6. Method as claimed in claim 5, wherein the zipper is stuck on and attached to a bag.

* * * * *